US006592023B2

(12) United States Patent
Li Vigni et al.

(10) Patent No.: US 6,592,023 B2
(45) Date of Patent: Jul. 15, 2003

(54) RIGID CONTAINER FOR TOBACCO PRODUCTS

(75) Inventors: Angelo Li Vigni, Bologna (IT); Fiorenzo Draghetti, Bologna (IT)

(73) Assignee: G. D S.p.A., Bologna (IT)

( * ) Notice: Subject to any disclaimer, the term of this patent is extended or adjusted under 35 U.S.C. 154(b) by 0 days.

(21) Appl. No.: 10/308,050

(22) Filed: Dec. 3, 2002

(65) Prior Publication Data

US 2003/0106928 A1 Jun. 12, 2003

(30) Foreign Application Priority Data

Dec. 11, 2001 (IT) ..... BO2001A747

(51) Int. Cl.[7] ..... B65D 43/16

(52) U.S. Cl. ..... 229/146; 229/115; 229/160.1; 229/182.1

(58) Field of Search ..... 229/115, 146, 229/160.1, 182.1; 206/268, 273

(56) References Cited

U.S. PATENT DOCUMENTS 1,996,997 A * 4/1935 Inman ..... 229/115
5,097,948 A * 3/1992 Campbell ..... 229/146
5,143,282 A * 9/1992 Pham ..... 229/160.1
5,529,180 A * 6/1996 Paolucci et al. ..... 206/273
5,806,671 A * 9/1998 Focke et al. ..... 229/160.1
5,873,514 A * 2/1999 Brooks ..... 229/115
5,896,984 A * 4/1999 Focke et al. ..... 206/268
6,276,600 B1 * 8/2001 Rigby ..... 206/273
6,302,322 B1 * 10/2001 Focke et al. ..... 229/160.1
6,311,834 B1 * 11/2001 Focke et al. ..... 229/160.1
6,370,846 B1 * 4/2002 Schoch et al. ..... 206/268
6,484,930 B1 * 11/2002 Draghetti ..... 229/146

FOREIGN PATENT DOCUMENTS

DE 3615827 A1 * 11/1987 ..... 493/480
DE 3615828 A1 * 11/1987 ..... 206/242
WO 0043289 7/2000
WO 0115999 3/2001
WO 0144077 6/2001

* cited by examiner

*Primary Examiner*—Gary E. Elkins
(74) *Attorney, Agent, or Firm*—Davidson Berquist Klima & Jackson LLP

(57) ABSTRACT

A rigid container for tobacco products is prismatic in shape, substantially rectangular or triangular in section, and presents a plurality of side faces each presenting a flat central portion and two longitudinally oriented lateral bands of curved profile of which the concave surface is directed toward the inside of the container; the contiguous lateral bands of each two adjacent side faces are joined one to the other along a sharp longitudinal corner edge.

20 Claims, 6 Drawing Sheets

RIGID CONTAINER FOR TOBACCO PRODUCTS

BACKGROUND OF THE INVENTION

The present invention relates to a rigid container for tobacco products.

The invention finds application to particular advantage in the manufacture of hinge-lid cigarette packets fashioned from relative flat precreased and diecut blanks of cardboard or the like, to which reference is made explicitly in the following specification albeit implying no limitation.

The traditional type of rigid packet appears as a parallelepiped of rectangular section with sharp longitudinal corner edges; such a packet presents certain drawbacks deriving from a shape not readily adaptable to the human anatomy, and from the fact that the aforementioned longitudinal corner edges can occasion wear on the pockets of garments worn by the smoker.

These problems have been addressed by the prior art, which offers a rigid packet with longitudinal corner edges presenting a rounded profile that has a radius of curvature matched to that of a single cigarette. In addition to overcoming the drawbacks mentioned above, this type of packet affords the advantage that it can be fashioned from a flat diecut blank of smaller surface area than that of traditional blanks, thus bringing a cost benefit. Nonetheless, it has been found that a packet made in this way still presents certain drawbacks.

A first drawback is that the absence of sharp longitudinal corner edges results in a diminished structural rigidity tending to render the packet easily deformable, especially along the rounded corner edges. Any deformation of the rounded corner edge will impact directly on the single cigarette occupying this same corner of the packet, given that approximately one quarter of the cylindrical surface area presented by the cigarette is breasted with the internal surface presented by the radiused band of material coinciding with each one of the four longitudinal corner edges.

A second drawback is that the rounded corner edges in question can be produced only by making extensive modifications to conventional packer machines. In particular, complex deforming steps are required in order to precrease the areas of the blank that will provide the bands constituting the rounded corner edges on the finished packet.

Another drawback is that traditional cellophaners of the type used to envelop single packets with a sheet of transparent overwrapping material were designed originally to handle parallelepiped packets with sharp longitudinal corner edges. Such overwrapping machines have been found unsuitable for packets of the type referred to here. Most noticeably, surplus material tends to bunch around the top and bottom end faces at the ends of the rounded corner edges, forming unsightly creases and folds which in particular will project from the faces of the packet once the heat seal step has been effected.

The object of the present invention is to fashion a rigid container for tobacco products that will be free of the drawbacks mentioned above.

SUMMARY OF THE INVENTION

The stated object is realized according to the present invention in a rigid container for tobacco products appearing prismatic in shape, which comprises a top end face, a bottom end face and a plurality of side faces. At least two mutually adjacent side faces of the container each present a respective flat portion and at least one longitudinal lateral band of curved profile with the concave surface directed inwards, embodied in such a way that the lateral bands of the two adjacent faces are joined one to another along a sharp longitudinal corner edge.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
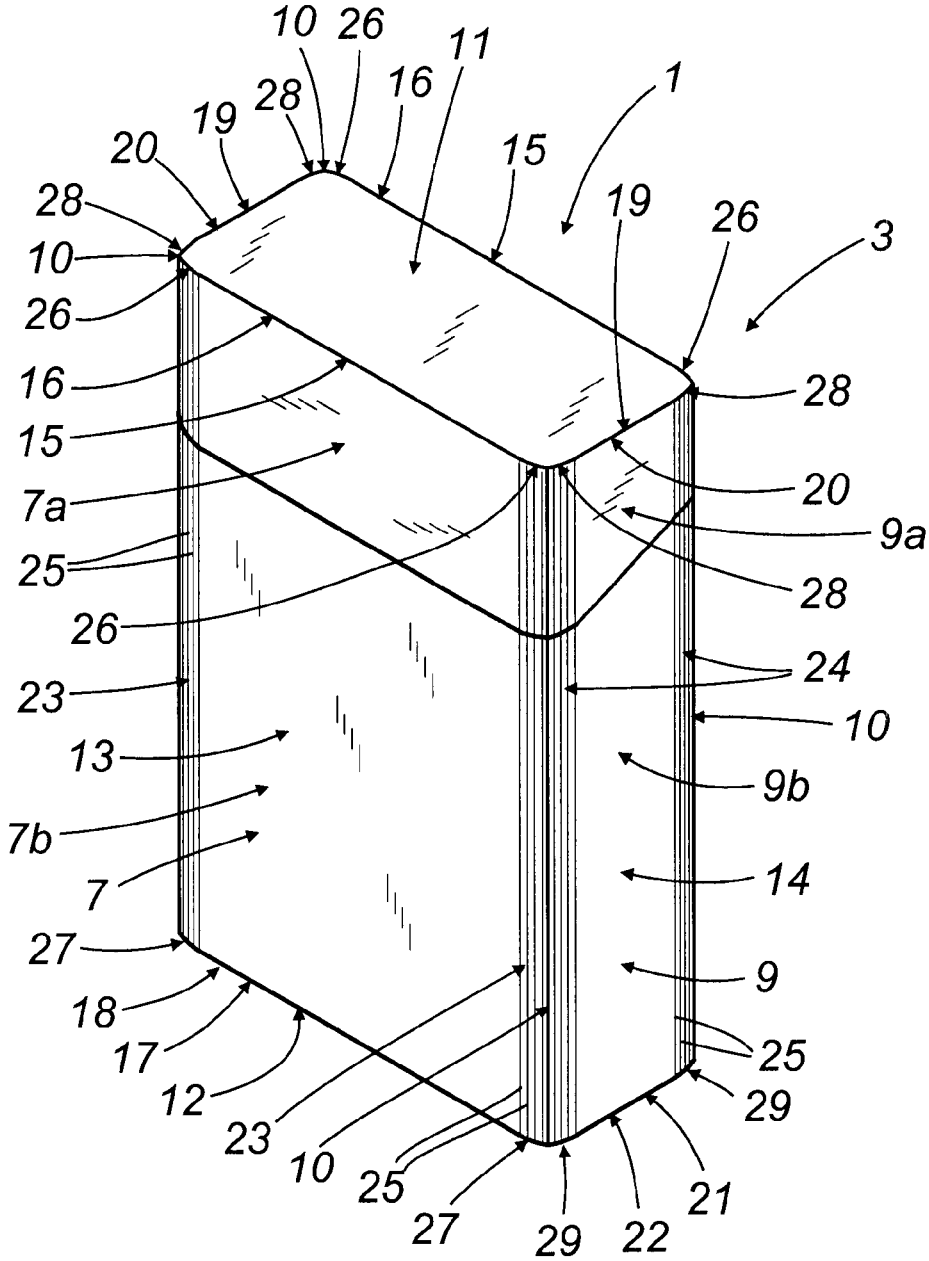
FIG. 1 illustrates a packet representing a first embodiment of the container according to the present invention, viewed in perspective from the front and shown in a closed configuration.

FIGS. 1, 2 and 3 and FIGS. 8 and 9 of the drawings illustrate two packets of cigarettes as examples of the rigid container for tobacco products according to the present invention. The respective packets are denoted 1 in FIGS. 1, 2 and 3, and 2 in FIGS. 8 and 9. Both packets 1 and 2 are prismatic in appearance, comprising a container 3 with an open top end, denoted 4, surmounted by a lid 5 hinged to the container 3 and rotatable thus relative to the container 3 between an open position and a closed position in which the top end 4 is concealed, and serve to accommodate a respective group of cigarettes 6 (indicated in FIGS. 2 and 9).

Figure 2:
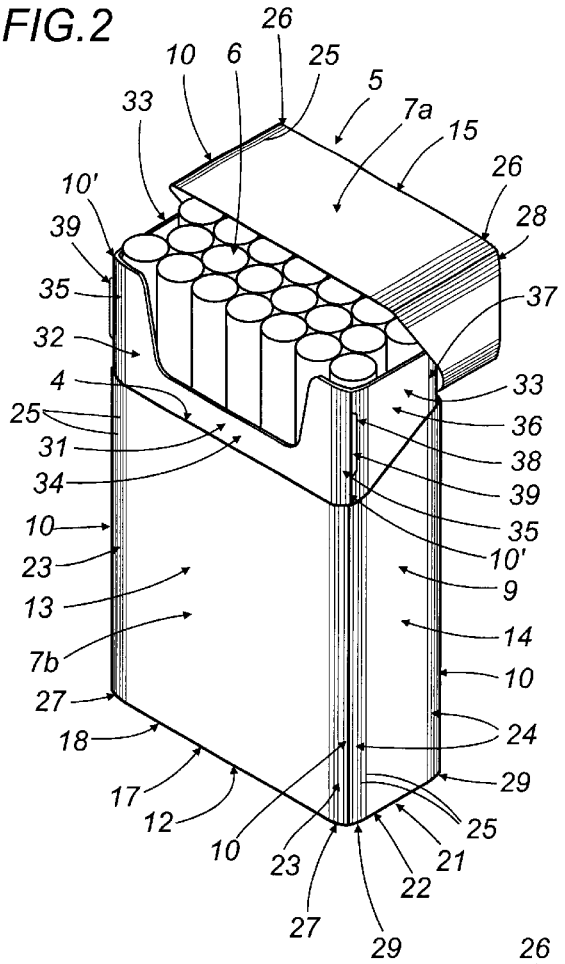
FIG. 2 shows the packet of FIG. 1 in the open configuration, viewed in perspective from the front.
Figure 3:
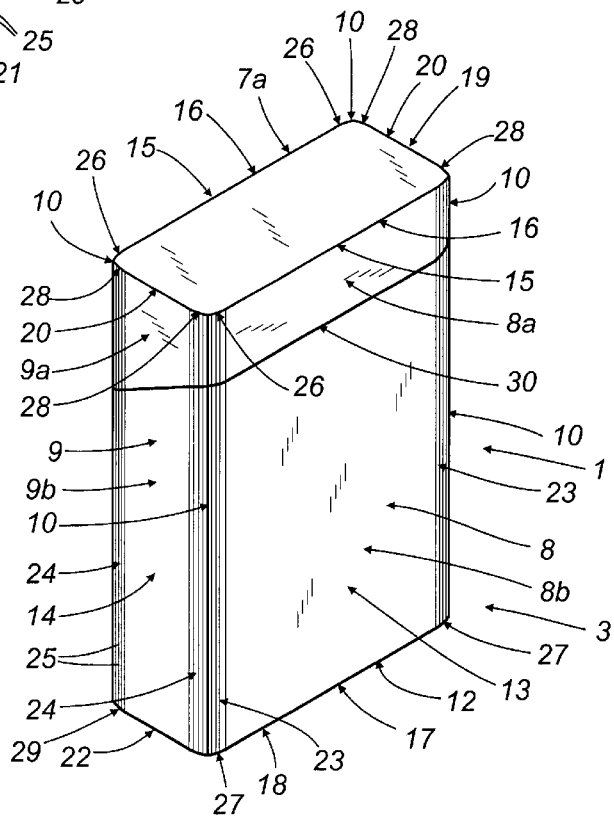
FIG. 3 shows the packet of FIG. 1 in the closed configuration, viewed in perspective from the rear.

With the lid 5 occupying the closed position, in the example of FIGS. 1, 2 and 3, the packet 1 assumes the appearance of a substantially rectangular parallelepiped compassed by four side faces, namely a front face 7 and a rear face 8 parallel one with another, two flank faces 9 substantially parallel one with another and substantially perpendicular to the front and rear faces 7 and 8 and joined to these same faces 7 and 8 along respective sharp corner edges 10, also a top end face 11 and a bottom end face 12 parallel one with another and perpendicular to the side faces 7, 8 and 9.

The four side faces 7, 8 and 9 are externally convex, and more exactly, each of the larger side faces 7 and 8 presents a flat central portion 13 of substantially rectangular outline; similarly, each of the flank faces 9 presents a flat central portion 14 of substantially rectangular outline. The flat central portions 13 of the larger faces are delimited at the top by a rectilinear central portion 15 presented by one longer side 16 of the top end face 11, and delimited at the bottom by a rectilinear central portion 17 presented by one longer side 18 of the bottom end face 12; the top and bottom rectilinear central portions 15 and 17 are identical one to another.

Similarly, the flat central portions 14 of the flank faces are delimited at the top by a rectilinear central portion 19 presented by one shorter side 20 of the top end face 11, and delimited at the bottom by a rectilinear central portion 21 presented by one shorter side 22 of the bottom end face 12; the top and bottom rectilinear central portions 19 and 21 are identical one to another.

Each larger face 7 and 8 further comprises two longitudinal lateral bands 23 located one on each side of the central portion 13; similarly, each flank face 9 further comprises two longitudinal lateral bands 24 located one on each side of the central portion 14. In particular, each lateral band 23 of the larger faces 7 and 8 is joined to a respective lateral band 24 of the flank faces 9 along a sharp corner edge 10.

Moreover, each lateral band 23 of the larger faces 7 and 8 extends laterally from the respective central portion 13 with no break in continuity, that is to say with no discontinuity in the variation of its curvature; similarly, each lateral band 24 of the flank faces 9 extends laterally from the respective central portion 14 with no break in continuity, that is to say no discontinuity in the variation of its curvature.

Each band 23 and 24 is rendered pliable by longitudinal crease lines 25, so as to assume a curved profile with the concave surface directed toward the inside of the packet 1. In particular, each band 23 of the larger faces 7 and 8 presents a top edge offered to a curved portion 26 presented by the longer side 16 of the top end face 11, and a bottom edge offered to a curved portion 27 presented by the longer side 18 of the bottom end face 12; the top and bottom curved portions 26 and 27 are identical one to another.

Similarly, each band 24 of the flank faces 9 presents a top edge offered to a curved portion 28 presented by the shorter side 20 of the top end face 11, and a bottom edge offered to a curved portion 29 presented by the shorter side 22 of the bottom end face 12; the top and bottom curved portions 28 and 29 are identical one to another.

In the light of the foregoing it will be evident that the distance between the central portions 13 of the larger faces 7 and 8, measured normal to these same faces, is greater than the corresponding distance between the corner edges 10, and similarly, the distance between the central portions 14 of the flank faces 9, measured normal to these same faces, is greater than the corresponding distance between the corner edges 10.

The front, rear and flank faces 7, 8 and 9 each include an upper portion denoted by the suffix "a", coinciding with a relative face of the lid 5, and a lower portion denoted by the suffix "b" coinciding with a relative face of the container 3, whilst the top end face 11 coincides with the top of the lid 5 and the bottom end face 12 with the bottom of the container 3.

With the lid 5 occupying the closed position, the three upper portions 7*a*, 8*a* and 9*a* lie with the respective free edges offered to corresponding free edges of the lower portions 6*b*, 7*b* and 7*b*, whilst the edge presented by the rear face 8*a* of the lid 5 is joined permanently to the edge presented by the rear face 8*b* of the container 3, the two combining to create a hinge 30 about which the lid 5 is rotatable between the open and closed positions.

As illustrated in FIG. 2, the rigid packet 1 comprises a stiffening frame 31 of U-profile projecting partially beyond the open top end 4, composed of a breast piece 32 rigidly associated with the inside of the front face 7, and, connected to the breast piece 29, two side pieces 33 each rigidly associated which the inside of a relative flank face 9.

The breast piece 32 presents a flat central portion 34 destined to adhere in part to the respective inside surface of the flat central portion 13 presented by the front face 7 of the packet 1, and two respective precreased lateral bands 35 of curved profile destined to adhere in part to the inside surfaces of the lateral bands 23 presented by the front face 7 of the packet 1. Similarly, each side piece 33 of the frame 31 presents a flat central portion 36 destined to adhere in part to the respective inside surface of the flat central portion 14 presented by the relative flank face 9 of the packet 1, and two respective precreased lateral bands 37 of curved profile destined to adhere in part to the inside surfaces of the lateral bands 24 presented by the flank face 9.

The lateral bands 35 presented by the breast piece 32 of the frame 31 are connected to the respective bands 37 of the side pieces 33 by way of respective sharp corner edges 10' extending substantially in vertical alignment with the corner edges 10 of the packet 1.

Each lateral band 35 and 37 is rendered pliable by a respective plurality of longitudinal crease lines, and each corner edge 10' presents a longitudinal U-shaped slot 38 serving to create a respective lip 39 positioned to interact with an internal surface of the lid 5 in such a way that the lid 5 is held stably in the closed position.

It will be seen that the lip 39 projects sideways from the respective lateral band 35 in such a way as to constitute an appendage of the band 35. Thanks to the incorporation of the sharp corner edge 10', the appendage projects from the corresponding band 37 sufficiently to guarantee an effective retaining action on the lid 5 when in the closed position.

Figure 4:
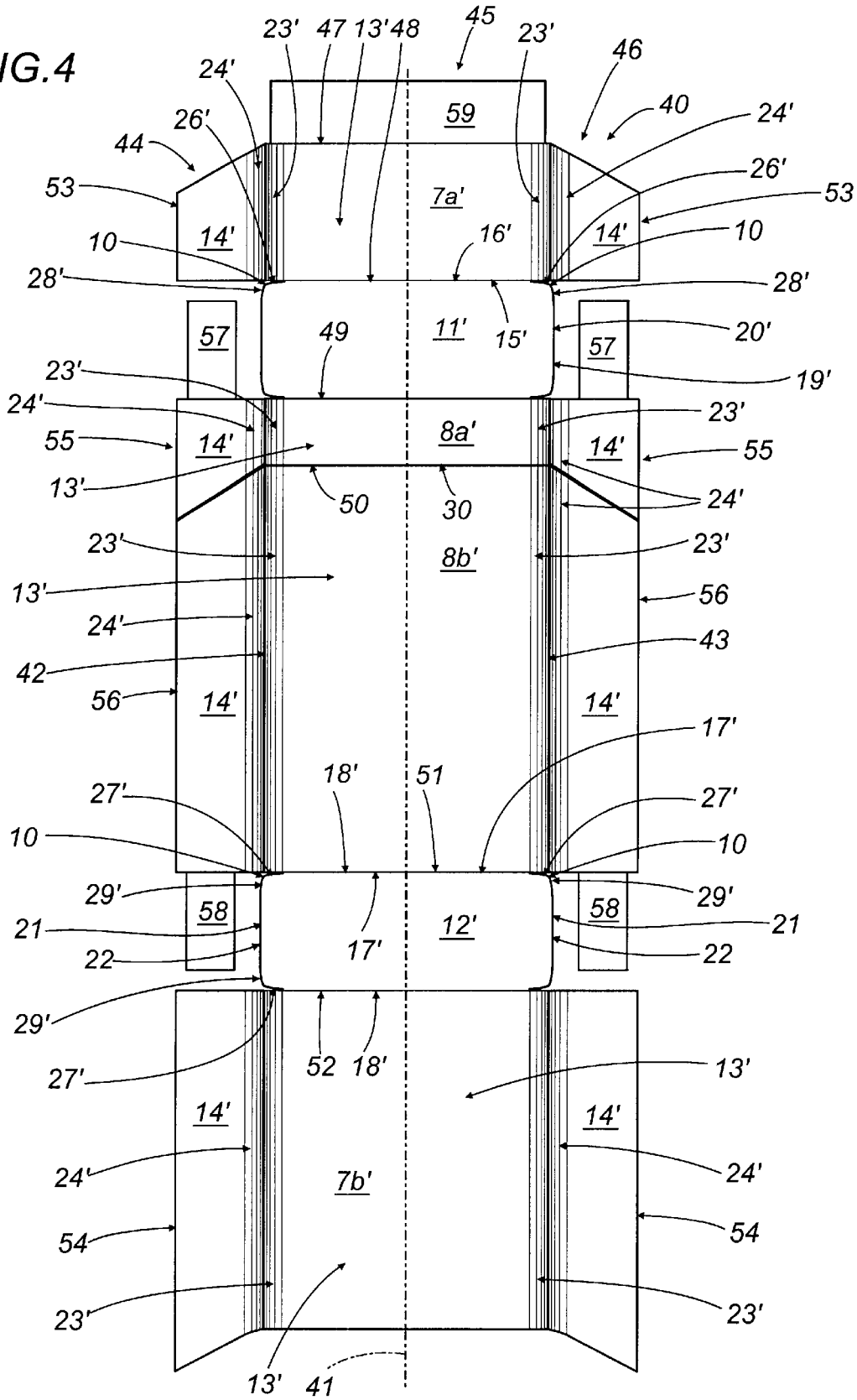
FIG. 4 shows a diecut blank used to manufacture the packet of FIG. 1.

Referring to FIG. 4, the packet 1 is fashioned from a flat diecut blank 40 of substantially elongated rectangular outline, of which the parts are denoted where possible using the same numbers, primed, as those used to indicate the corresponding parts of the erected packet 1.

The blank 40 is referable to a predominating longitudinal axis 41 of symmetry and presents two longitudinal crease lines 42 and 43 disposed one on either side of the axis 41, dividing the blank 40 into three longitudinal sectors 44, 45 and 46 lying side by side. The three sectors 44, 45 and 46 are crossed by a plurality of crease lines transverse to the axis 41 and denoted by the numbers 47 to 52.

The middle sector 45 is divided by the transverse crease lines 47 to 52 into: a panel 7*a*' positioned between the lines denoted 47 and 48; a panel 11' between lines 48 and 49; a panel 8*a*' between lines 49 and 50; a panel 8*b*' between lines 50 and 51; a panel 12' between lines 51 and 52, substantially identical to the panel denoted 11'; and an end panel 7*b*' joined to the panel denoted 12'.

The blank 40 further comprises a plurality of lateral wings 53, 54, 55 and 56 presenting a substantially trapezoidal outline, joined in pairs via the longitudinal crease lines 42 and 43 to the outer edges of the panels 7*a*', 7*b*', 8*a*' and 8*b*', respectively, of which the wings denoted 55 carry longitudinal appendages 57 joined along the transverse crease line denoted 49 and directed toward the wings denoted 53. Similarly, the wings denoted 56 carry longitudinal appendages 58 joined along the transverse crease line denoted 51 and directed toward the wings denoted 54.

The panels 7*a*' and 7*b*' making up the front face 7 and the panels 8*a*' and 8*b*' making up the rear face 8 present respective flat central portions 13' coinciding with the respective flat central portions 13 presented by the front and rear faces 7 and 8 of the packet 1. These same panels 7*a*', 7*b*', 8*a*' and 8*b*' present two bands 23', one on each side of the relative central portion 13', coinciding with the lateral bands 23 of the packet 1.

In like manner, the wings 53, 54, 55 and 56 making up the flank faces 9 of the erected packet 1 comprise respective flat portions 14' each forming a part of one respective flat central portion 14 of the flank faces 9 of the packet 1, and a respective precreased longitudinal band 24' interposed between the respective flat portion 14' and the bands 23' of the respective panels 7*a*', 7*b*', 8*a*' and 8*b*' to which they are joined along the longitudinal crease lines 42 and 43 destined to become the sharp longitudinal corner edges 10 of the packet 1.

The panel 7*a*' first mentioned is also joined along the first transverse crease line 47 to a reinforcing flap 59 of width substantially equal to the width of the selfsame panel 7*a*'.

Figure 5A:
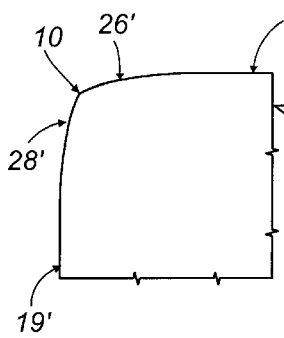
FIGS. 5*a*, 6*a* and 7*a* are enlarged details of FIGS. 5, 6 and 7, respectively.
Figure 5:
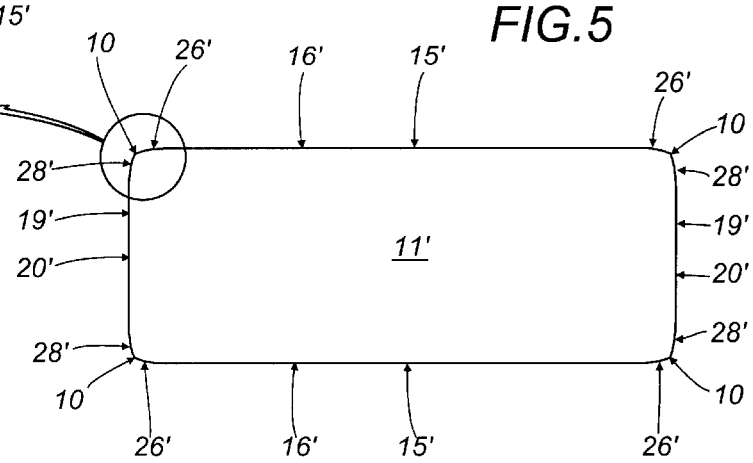
FIGS. 5 and 6 show the packet of FIG. 1 obtained from the blank of FIG. 4, viewed in plan from above and from beneath, respectively.
Figure 6A:
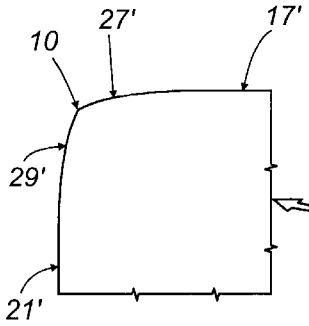
Figure 6:
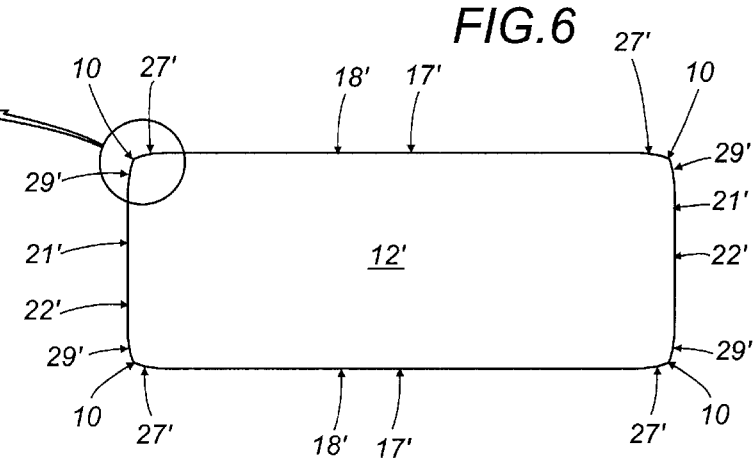

Observing FIGS. 5 and 6, it will be seen that the panel 11' coinciding with the top end face 11 of the packet 1 is essentially rectangular and connected to the adjoining panels 7*a*' and 8*a*' along respective rectilinear central portions 15' of the respective longer sides 16', of which the curved end portions 26' are detached from the lateral bands 23' of the selfsame panels 7*a*' and 8*a*'.

In like manner, the panel 12' coinciding with the bottom end face 12 of the packet 1 is essentially rectangular and connected to the adjoining panels 7*b*' and 8*b*' along respective rectilinear central portions 17' of the respective longer sides 18', of which the curved end portions 27' are detached from the lateral bands 23' of the selfsame panels 7*b*' and 8*b*'.

It will be seen also that the longitudinal shorter sides 20' of the one panel 11' are substantially aligned on the longitudinal crease lines 42 and 43 and convexly profiled, each presenting a rectilinear central portion 19' and two curved end portions 28' joined to the corresponding curved end portions 26' of the longer sides by way of the relative sharp corner edge 10.

Similarly, the longitudinal shorter sides 22' of the other panel 12' are substantially aligned on the longitudinal crease lines 42 and 43 and convexly profiled, each presenting a rectilinear central portion 21' and two curved end portions 29' joined to the corresponding curved end portions 27' of the longer sides by way of the relative sharp corner edge 10.

Figure 7A:
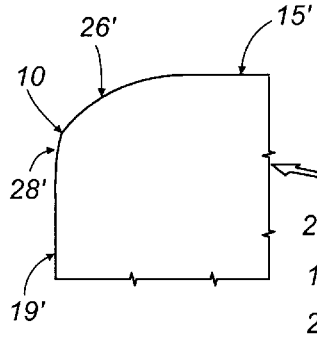
Figure 7:
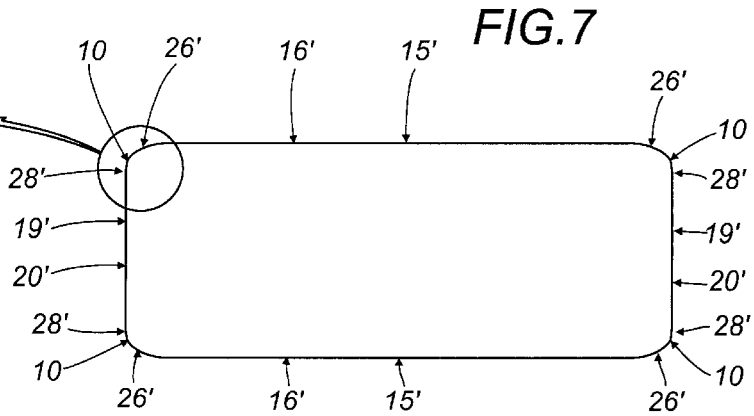
FIG. 7 illustrates a variation on the packet of FIG. 1, viewed in plan from above.

Referring to FIGS. 7 and 7*a*, it will be seen that the radii of the curved portions denoted 26', and consequently of the portions denoted 27', can differ from the radii of the curved portions denoted 28', and consequently of the portions denoted 29'. Accordingly, the width of the relative bands 23' and 24' will vary in proportion. The hinge 30 coincides with the transverse crease line denoted 50.

The longer wings 54 and 56 will be bent at right angles to the respective panels 7*b*' and 8*b*' with which they are associated. These same panels 7*b*' and 8*b*' are then bent toward one another at right angles to the intermediate panel 12', with the result that the wings 56 of one pair will overlap the wings 54 of the other pair, causing the lateral bands 24' of the selfsame wings 54 and 56 to assume a curved profile relative to the associated flat portions 14' and thus form the flank faces 9*b* of the container 3, and causing the lateral bands 23' of the panels 7*b*' and 8*b*' likewise to assume a curved profile relative to the flat portions 13' and thus form the front and rear faces 7*b* and 8*b* of the container 3. Similarly, the appendages 58 are bent inwards at right angles to the respective wings 56 and rotated together with the wings 56 to the point of engaging the inside surface of the corresponding panel 12', with which they combine to establish the bottom end face 12 of the packet 1.

In like manner, the shorter wings 53 and 55 are bent at right angles to the respective panels 7*a*' and 8*a*' with which they are associated. The flap 59 is bent double against the internal surface of the adjoining panel 7*a*', whereupon the two panels 7*a*' and 8*a*' are bent toward one another at right angles to the intermediate panel 11' so that the wings 53 of one pair ultimately overlap the wings 55 of the other pair, causing the lateral bands 24' to assume a curved profile in relation to the associated flat portions 14' and thus form the flank faces 9*a* of the lid 5, and causing the lateral bands 23' of the panels 7*a*' and 8*a*' likewise to assume a curved profile relative to the flat portions 13' and form the front and rear faces 7*a* and 8*a* of the lid 5. Similarly, the appendages 57 are bent inwards at right angles to the respective wings 55 and rotated together with the wings 55 to the point of engaging the inside surface of the corresponding panel 11', with which they combine to establish the top end face 11 of the packet 1.

The two longitudinal lines 42 and 43 are creased more forcibly than the lines 25 generating the lateral bands 23' and 24', so that when the diecut blank 40 is bent in the manner described above along these same crease lines 42 and 43, the sharp corner edges 10 of the packet 1 will be formed decisively and without difficulty.

It will be seen that the operations of folding the blank 40 as described above are pertinent only to the container 3 and the lid 5; accordingly, the stiffening frame 31 is prepared preferably by means of separate folding operations and then assembled with the container 3.

Figure 8:
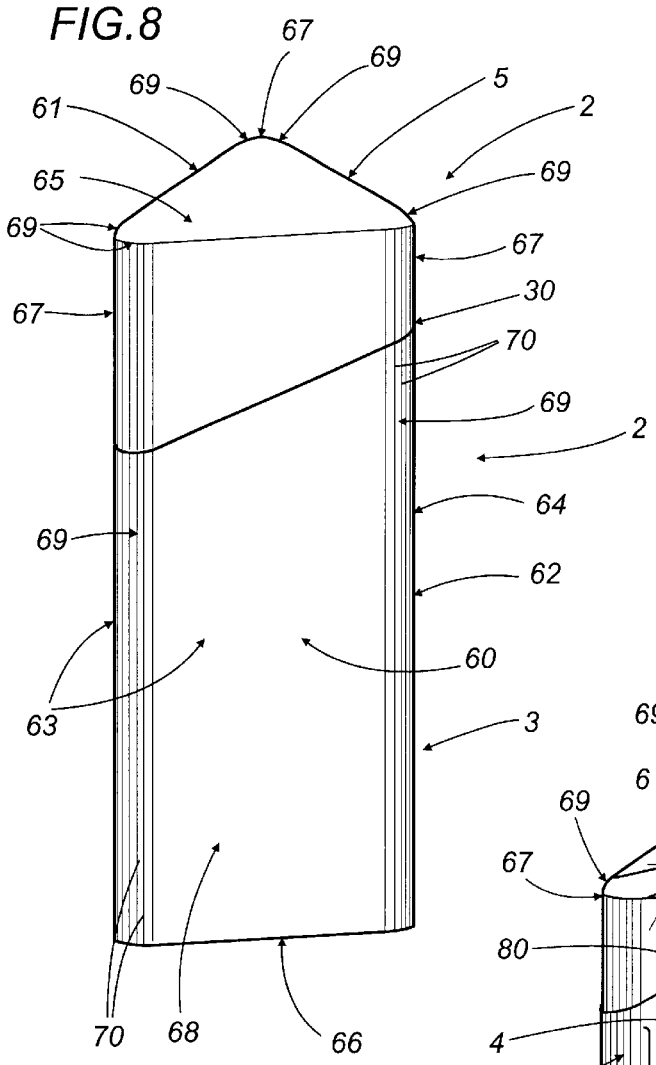
FIGS. 8 and 9 illustrate a packet representing a second embodiment of the container according to the present invention, viewed in perspective.
Figure 9:
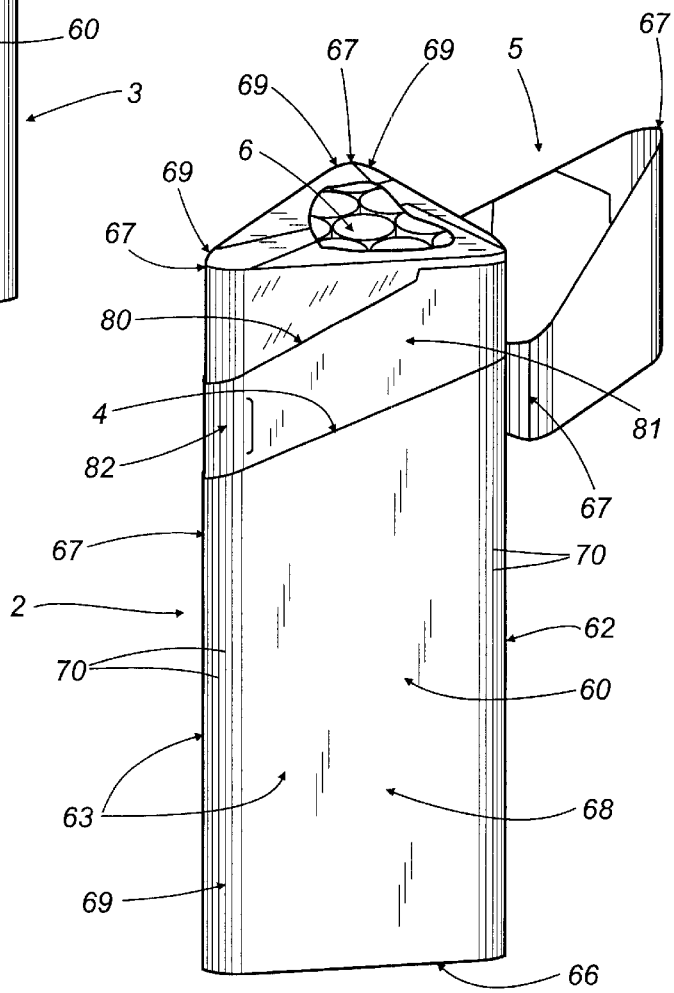

In the example of FIGS. 8 and 9, the packet 2 appears as a prismatic solid of substantially triangular cross section, comprising three side faces 60, 61 and 62 of which the two denoted 60 and 61 combine to establish a front face 63, and the remaining side 62 establishes a rear face. The top and the bottom end faces of the packet 2 are denoted 65 and 66 respectively. The side faces 60, 61 and 62 are joined one to the next along respective sharp corner edges 67.

In like manner to the packet 1 described above, the three side faces 60, 61 and 62 of the packet 2 present a convex profile; more exactly, each face comprising a substantially rectangular flat central portion 68 and two longitudinal lateral bands 69 disposed on opposite sides of the relative central portion 68, each joined to the corresponding lateral band 69 of the adjacent face along a relative sharp corner edge 67.

Each band 89 is rendered pliable by longitudinal crease lines 70, so as to assume a curved profile with the concave surface directed toward the inside of the packet 2.

Figure 11:
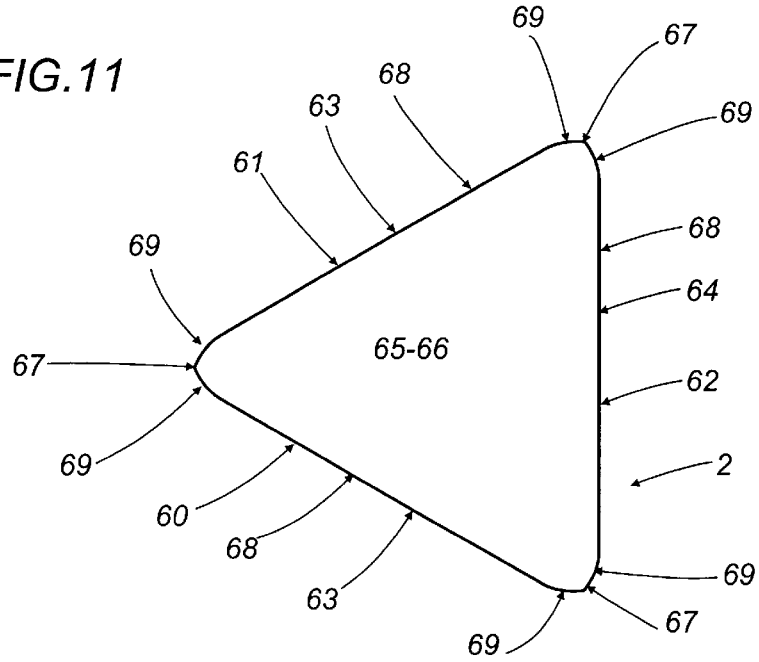
FIG. 11 shows the packet of FIG. 8 obtained from the blank of FIG. 10, viewed in plan.

As discernible from FIG. 11, each side of the top end face 65 and of the bottom end face 66 presents a rectilinear portion coinciding with the end of the flat central portion 68 presented by the side faces 60, 61 and 62, and respective curved end portions coinciding with the ends of the lateral bands 69.

Figure 10:
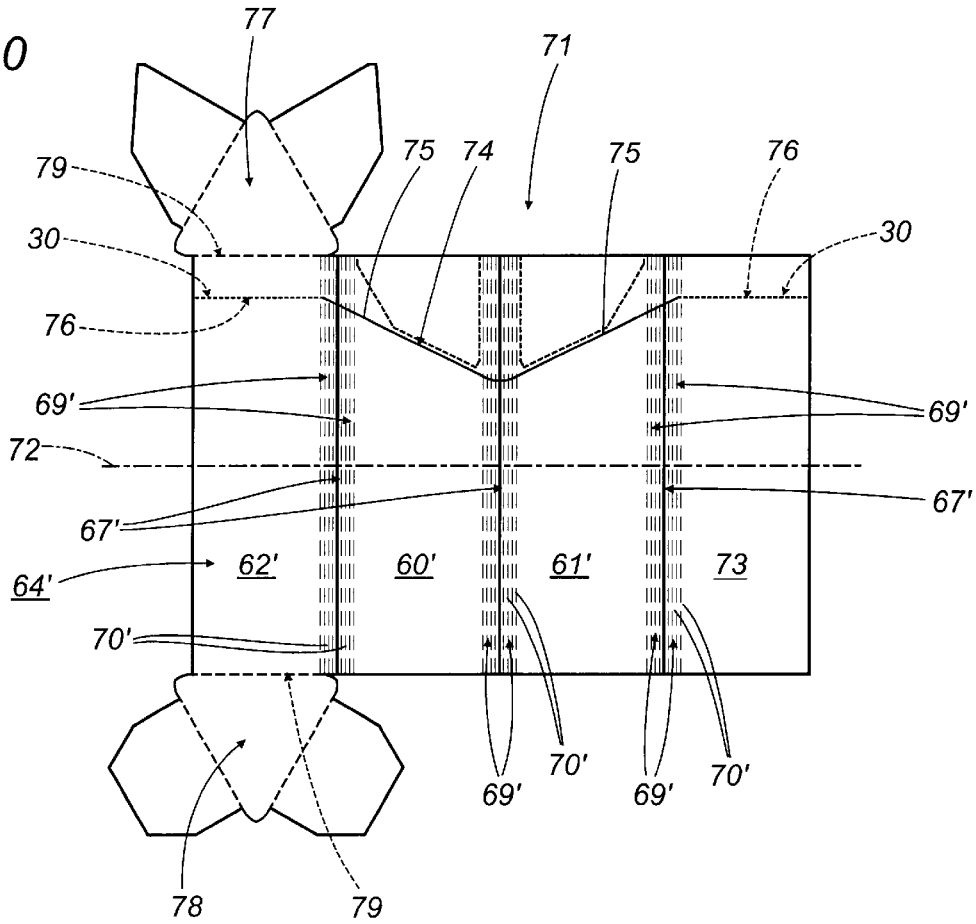
FIG. 10 shows a diecut blank used to manufacture the packet of FIG. 8.

Referring to FIG. 10, the packet 2 is fashioned from a flat diecut blank 71 of substantially elongated rectangular outline, of which the parts are denoted where possible using the same numbers, primed, as those used to indicate the corresponding parts of the erected packet 2.

In particular, the flat blank 71 is referable to a predominating transverse axis 72 and presents three mutually parallel precreased bend lines 67' delimiting two panels 60' and 61' making up the front face 63 of the packet 2, a panel 64' coinciding with the rear face 64 of the packet 2, and a connecting panel 73 that will be breasted ultimately in contact with the inside surface of the back panel 64'.

The panels 60', 61', 64' and 73' of the blank 71 also presents lateral bands 69' located on either side of each bend line 67' and rendered pliable by crease lines denoted 70'.

The blank 71 also presents a transversely placed Vee cut 42 intersecting the three precreased bend lines 67', and more exactly composed of two angled legs 75 converging onto the central precreased bend line 67'. The two ends of the cut 74 are joined to respective crease lines 76 extending transversely to the bend lines 67' and functioning as the hinge of the lid 5.

The panel 64' coinciding with the rear face of the packet 2 is associated with a top wing 77 and a bottom wing 78, each joined to the panel 64' along a relative crease line 79. The two wings 77 and 78 are substantially triangular and serve respectively to establish the top end face 65 and the bottom end face 66 of the packet 2. The precreased bands 69' serve to establish respective longitudinal lateral bands 69 designed to assume a curved profile with the concave surface directed toward the inside of the packet 2.

It will be observed that the second packet 2 comprises a frame 80 in like manner to the first, in this instance furnished with two side pieces 81 joined by a central precreased band 82 breasted in contact with the inside surface of the band 69 presented by the front face 63.

The present invention is applicable likewise to containers embodied as cartons, designed to hold a plurality of packets of cigarettes and differing from the packets 1 and 2 described above only in terms of size.

What is claimed is:

1. A rigid container for tobacco products appearing prismatic in shape, comprising a top end face, a bottom end face and a plurality of side faces, wherein at least two mutually adjacent side faces each present a respective flat portion and at least one longitudinal lateral band of curved profile with the concave surface directed inwards, and the lateral bands of the two adjacent faces are joined one to another along a sharp longitudinal corner edge.

2. A container as in claim 1, appearing substantially parallelepiped in shape.

3. A container as in claim 1, appearing prismatic in shape and triangular in section.

4. A container as in claim 1, wherein each side face presents a respective flat portion, also two lateral bands of curved profile with the concave surface directed inwards, along which the flat portion is joined to the flat portions of the two adjacent faces by way of respective sharp corner edges.

5. A container as in claim 1, comprising a hinged lid.

6. A container as in claim 5, comprising a front face and a rear face substantially parallel one with another, and two mutually parallel flank faces substantially perpendicular to the front and rear faces.

7. A container as in claim 1, wherein the lateral bands of curved profile present a plurality of longitudinal crease lines.

8. A container as in claim 6, wherein the distance between the flat central portions of each pair of mutually opposed side faces is greater than the distance between the sharp corner edges relative to each pair of side faces.

9. A container as in claim 5, comprising a container of cupped appearance with an open top end, a lid likewise of cupped appearance hinged to the open top end and rotatable between positions in which the container is open and closed, and a stiffening frame anchored to the container and projecting in part from the open top end.

10. A container as in claim 1, fashioned from a flat diecut blank of cardboard or similar material, referable to a predominating axis and presenting a substantially rectangular outline.

11. A container as in claim 10, fashioned from a blank referable to a predominating longitudinal axis, presenting two longitudinal crease lines and a plurality of transverse crease lines delimiting respective front panels, intermediate panels and rear panels of the lid and of the container between the longitudinal crease lines, of which the front panels and the rear panels are associated on opposite sides with corresponding pairs of longitudinally oriented lateral wings, wherein each front panel and each rear panel presents a flat central portion and two precreased lateral bands, and each of the longitudinally oriented lateral wings presents a flat portion and at least one precreased lateral band lying next to the precreased lateral band of the respective adjacent panel and joined to the selfsame panel along a respective longitudinal crease line destined to become the sharp corner edge.

12. A container as in claim 10, fashioned from a blank referable to a predominating transverse axis, presenting three precreased fold lines disposed mutually parallel and delimiting two panels coinciding with the front of the packet, one panel coinciding with the rear face, and one connecting panel; also a transverse Vee cut intersecting the three precreased fold lines, by which the front face of the container on the one hand is separated from the front face of the lid on the other, and two crease lines extending one from each end of the Vee cut, disposed transversely to the precreased fold lines and functioning as a hinge for the lid; two substantially triangular wings joined along one side to the blank by way of relative crease lines and coinciding respectively with the top end face and the bottom end face of the packet; and precreased lateral bands ordered in pairs one on either side of each precreased fold line, serving to establish the respective longitudinal lateral bands of curved profile with the concave surface directed toward the inside of the packet.

13. A container as in claim 2, wherein each side face presents a respective flat portion, also two lateral bands of curved profile with the concave surface directed inwards, along which the flat portion is joined to the flat portions of the two adjacent faces by way of respective sharp corner edges.

14. A container as in claim 3, wherein each side face presents a respective flat portion, also two lateral bands of curved profile with the concave surface directed inwards, along which the flat portion is joined to the flat portions of the two adjacent faces by way of respective sharp corner edges.

15. A container as in claim 4, comprising a hinged lid.

16. A container as in claim 2, wherein the lateral bands of curved profile present a plurality of longitudinal crease lines.

17. A container as in claim 6, wherein the lateral bands of curved profile present a plurality of longitudinal crease lines.

18. A container as in claim 4, fashioned from a flat diecut blank of cardboard or similar material, referable to a predominating axis and presenting a substantially rectangular outline.

19. A container as in claim 7, fashioned from a flat diecut blank of cardboard or similar material, referable to a predominating axis and presenting a substantially rectangular outline.

20. A container as in claim 9, fashioned from a flat diecut blank of cardboard or similar material, referable to a predominating axis and presenting a substantially rectangular outline.

* * * * *